United States Patent [19]

Rydström et al.

[11] Patent Number: 4,919,321

[45] Date of Patent: Apr. 24, 1990

[54] ARRANGEMENT FOR RIVETING

[75] Inventors: Sven-Olof Rydström, Sturefors; Mikael Johansson, Linkoping, both of Sweden

[73] Assignee: Saab-Scania AB, Linkoping, Sweden

[21] Appl. No.: 340,729

[22] PCT Filed: Oct. 14, 1987

[86] PCT No.: PCT/SE87/00465

§ 371 Date: Apr. 5, 1989

§ 102(e) Date: Apr. 5, 1989

[87] PCT Pub. No.: WO88/02673

PCT Pub. Date: Apr. 21, 1988

[30] Foreign Application Priority Data

Oct. 15, 1986 [SE] Sweden ..... 86043619

[51] Int. Cl.[5] ..... B27F 7/02

[52] U.S. Cl. ..... 227/69; 227/51

[58] Field of Search ..... 227/5, 58, 69, 52

[56] References Cited

U.S. PATENT DOCUMENTS 3,478,567 11/1969 Galutia ..... 227/61 X
3,534,896 10/1970 Speller et al. ..... 227/52
3,747,193 7/1973 Gregory ..... 227/52
4,515,302 5/1985 Davern et al. ..... 227/58
4,548,345 10/1985 Puritz et al. ..... 227/69 X

FOREIGN PATENT DOCUMENTS 0194983 9/1988 European Pat. Off. .
1652807 2/1968 Fed. Rep. of Germany .
3535761 10/1985 Fed. Rep. of Germany .
2148170 5/1985 United Kingdom .

*Primary Examiner*—Paul A. Bell
*Assistant Examiner*—James L. Wolfe
*Attorney, Agent, or Firm*—Lowe, Price, LeBlanc, Becker & Shur

[57] ABSTRACT

An arrangement for riveting of sheet material (33) with devices for drilling (7), for the positioning of rivets (8), for the driving of rivets (9) and for the positioning of a bucking bar device. The arrangement of the invention is characterized in that the three above-mentioned devices (7–9) are so arranged as to be capable of adjustment one at a time, into a certain operating position in relation to a frame (3). The frame (3) is precisely adjustable by means of a robot (6), in relation to the sheet material (33), on one side of the sheet material (33) while the bucking bar device (28) is adjustable on the other side of the sheet material (33) by means of a second robot (32).

7 Claims, 4 Drawing Sheets

ARRANGEMENT FOR RIVETING

The present invention relates to an arrangement for the riveting of sheet material, such as sheeting or laminate, for example made of metal, metal alloy, plastic or wood, etc., comprising a device for drilling, a device for the positioning of rivets, a device for repetitive striking movements and a bucking bar device.

Manual riveting has been used until now for the riveting of irregular sheet materials, i.e. workpieces with curved surfaces of the kind encountered in the manufacture of aircraft and other manufacturing of objects with complex forms. This has required an operative first to drill a hole with a hand tool, then to place a rivet in the resulting hole, and then, using a device for repetitive striking movements, to work in conjunction with a second operative applying a bucking bar device to the other end of the rivet in order to secure the rivet. Such manual work leads to circulation disorders in the operatives' fingers,. known as "white fingers".

The object of the present invention is accordingly to make available an arrangement of the kind referred to by way of introduction, by means of which workpieces with complex surfaces made of sheet material can be riveted in a rapid and reliable fashion so as to achieve riveted joints of high, uniform quality. An additional aim is that the arrangement must not require any manual proficiency on the part of the operative concerned, or cause industrial injury of the kind referred to above.

In accordance with the invention an arrangement of this kind is characterized in that the devices for drilling, for the positioning of the rivets and for the repetitive striking movements are so arranged as to be capable of being adjusted one at a time into one and the same operating position in relation to a frame, which by means of previously disclosed first positioning devices is freely adjustable in space in relation to the aforementioned sheet material, on one side of it, in conjunction with which the bucking bar device is freely adjustable by means of previously disclosed second positioning devices in space in relation to the aforementioned sheet material, on the other side of it, so arranged as to interact with the device for repetitive striking movements during the riveting operation. A large number of arrangements of the aforementioned devices for drilling, for the positioning of the rivets, and for repetitive striking movements are conceivable. They may, for example, be so arranged as to be capable of linear displacement along a guide path, in conjunction with which their directions of operation will normally form a right angle with the linear guide path. However, an arrangement of this kind is relatively ungainly and heavy. In an appropriate embodiment of the invention the aforementioned devices for drilling, for the positioning of the rivets and for the repetitive striking movements are so arranged as to be capable of pivoting in a plane about a shaft which is supported by the aforementioned frame. The aforementioned devices are preferably attached to a plate which is pivotally supported in a plane, preferably a horizontal plane, about the aforementioned shaft, in conjunction with which the operating directions of the aforementioned devices converge towards the centre of the aforementioned shaft. The ability of the plate to pivot can be achieved in a variety of ways. It is accordingly possible to use a linear motor with the appropriate coupling devices, or a pulse motor, which steps the plate between the desired positions. The plate may appropriately be so arranged as to be capable of being locked in the operating position of the aforementioned devices by means of a locking device. The aforementioned devices must be capable of being displaced one at a time from their rest positions to the radial position of the aforementioned operating position by means of driving devices. A common driving device of this kind is used for the aforementioned devices in an appropriate embodiment of the arrangement in accordance with the invention.

The bucking bar device can itself be executed in various ways. In an appropriate embodiment this device has a rivet-upsetting head or a stamping body so arranged as to be guided in a linear fashion in such a way as to move between a front end position and a rear end position in relation to a guide element, in conjunction with which the stamping body is caused by a force to move in a direction towards the front end position, and the guide element is capable of adjustment to a front position and to a rear position in relation to a housing, executed with a front shoulder surface for the purpose of making contact with the aforementioned sheet material.

The housing should be so executed that the guide element is capable of linear displacement in relation to it, appropriately by means of a linear motor. The stamping body should be executed with a broader part which is guided by a guide rail, for example of circular cross section, along which it is caused to advance by a helical spring which is supported against the rear part of the guide element. Attached to the broader part of the stamping body is appropriately a narrower part, which should be guided by a bushing in the front part of the housing. By executing the bucking bar device in this way, it is possible to cause the stamping body with its narrower part, which at its outer end is executed as a contact surface, to adopt one or other of two positions, depending on the adjustment of the aforementioned guide element. In the rear position the contact surface of the stamping body is withdrawn inside the shoulder surface of the housing to such an extent that space is provided to accommodate the drill when drilling through the sheet material. With the guide element in the front position the contact surface of the stamping body is adjusted so as to bear up against the rivet when the latter is subjected to repetitive impacts from the other side. The force which holds the stamping body in the front position in relation to the guide element can, of course, be produced by means other than a spring, for example by means of a cylinder with a piston under gas pressure.

The aforementioned first and second previously disclosed positioning devices are in the form of robots. Already disclosed are robots of a kind with which it is possible with great accuracy to position objects in space with six degrees of freedom. This means that the aforementioned frame on the one hand and the bucking bar device on the other hand can be adjusted with great precision in relation to the sheet material, i.e. the workpiece, in those positions in which it is wished to rivet it. As it may be necessary to introduce the bucking bar device into positions which are not easily accessible, this device may require to be equipped with an extension device adapted to this need.

In a preferred embodiment of an invention in accordance with the invention the frame 3 is so arranged as to be capable of displacement, preferably of a linear nature, in relation to the first positioning device 6, i.e. in relation to its outermost limb, so that a bracket 24 attached to the frame 3 is capable of being applied against the aforementioned sheet material at a predetermined force. This may be achieved for example, by regulating the pressure in the cylinders of a linear motor of the pneumatically actuated piston/cylinder type.

The invention is described below in more detail with reference to the accompanying drawings, in which.

Figure 1:
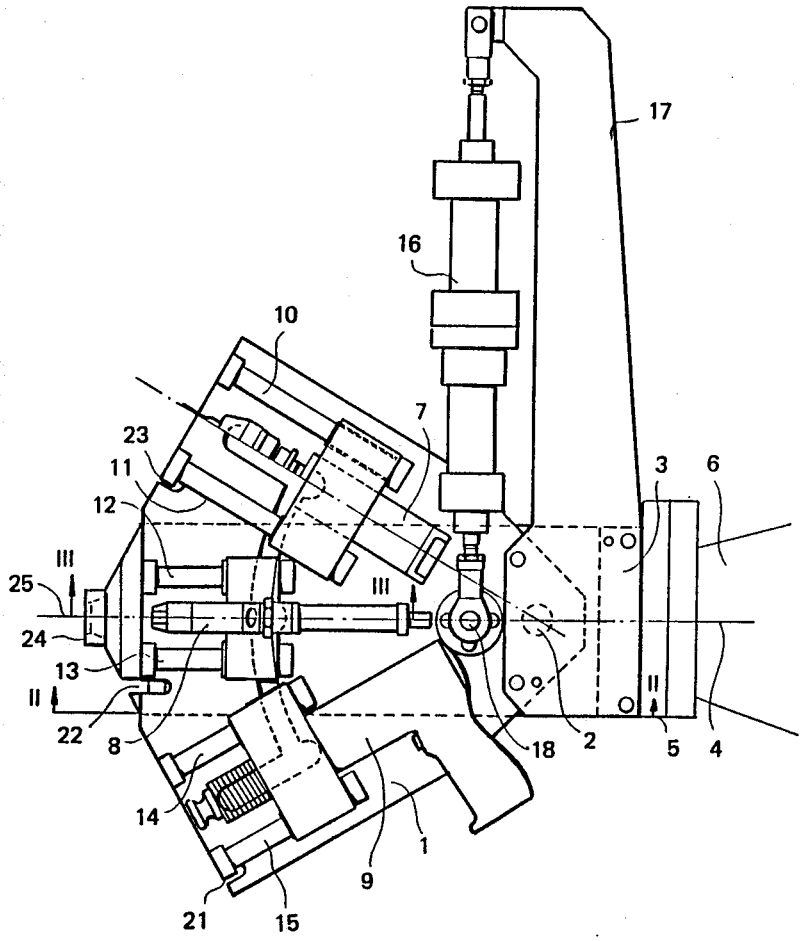
FIG. 1 illustrates a first embodiment of a part of an arrangement in accordance with the invention, viewed from above.
Figure 2:
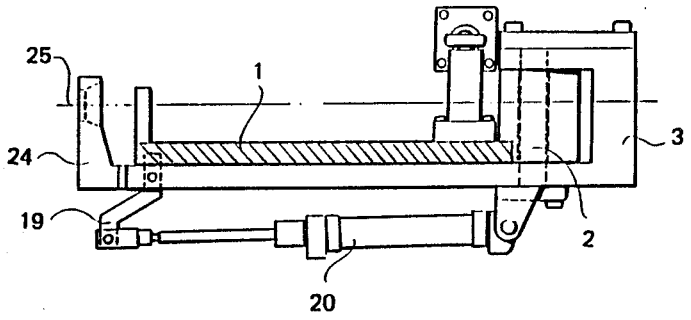
FIG. 2 illustrates a view along the line II—II marked in FIG. 1.

In FIGS. 1 and 2 the designation 1 is used for a plate capable of pivoting about a shaft 2, which is attached to a frame 3. This is capable of being caused to rotate about an axis of rotation 4 by means of a connection 5 attached to a first positioning device 6, for which no detailed description is given.

Mounted on the plate 1 are a device for drilling 7, a device for positioning the rivets 8 and a device for repetitive striking movements 9. All these devices are so arranged as to be capable of linear movement via guides 10,11, 12,13 and 14,15. Their directions of operation converge at the centre of the shaft 2. A linear motor 16, articulately attached to an arm 17 of the frame 3 and articulately attached to a pin 18 on the plate 1, is so arranged as to cause the latter to pivot about the shaft 2. The plate 1 is lockable by means of a locking device 19 which is capable of adjustment by means of a linear motor, in this case a piston/cylinder arrangement 20. The locking device interacts with sockets 21, 22 and 23 for the purpose of fixing the aforementioned devices in their operating position.

Figure 4:
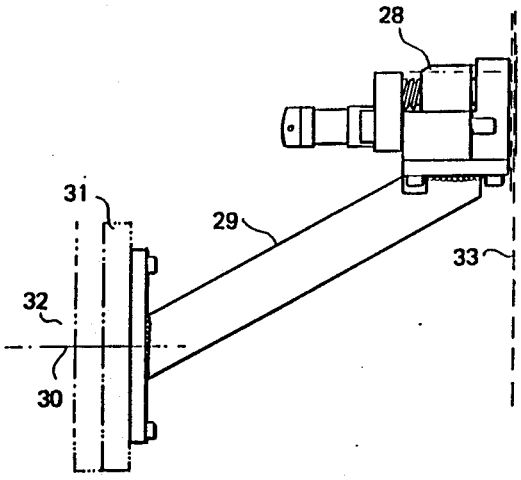
FIG. 4 illustrates a side view of a part of an arrangement in accordance with the invention.
Figure 3:
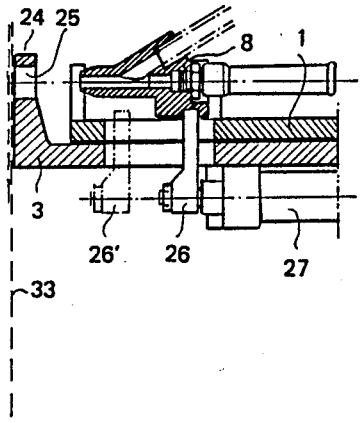
FIG. 3 illustrates a view along the line III—III marked in FIG. 1.
Figure 5:
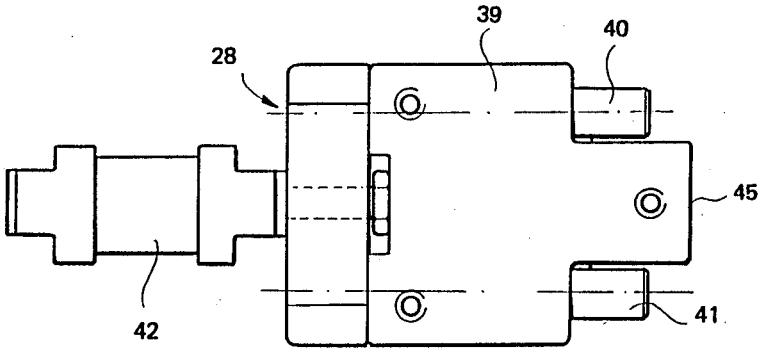
FIG. 5 illustrates a side view of a bucking bar device.
Figure 6:
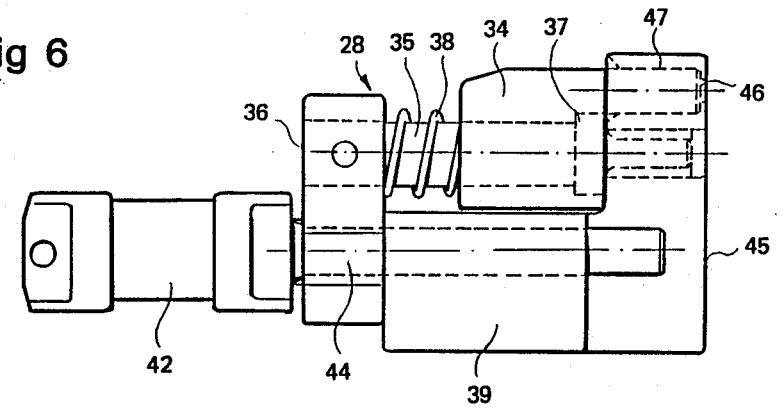
FIG. 6 illustrates a side view of the device illustrated in FIG. 5, rotated through 90°.

Once the plate 1 has been pivoted to the operating position of a device, the latter must be displaced in its operating direction, radially forwards into its radial operating position, and forwards as far as a bracket 24 attached to the frame 3. This bracket 24 is provided with an opening 25 which defines the riveting area, i.e. the area at the centre of which a rivet is to be applied. Illustrated in FIG. 3 is a driving device 26 which is driven by a linear motor 27. This driving device is illustrated both in a rear position, designated as 26, and in a front, extended position, designated as 26', in which latter position the illustrated device for the positioning of the rivets has been advanced into its radial operating position, although this has not been drawn in the Figure. The driving device is capable of displacement in the radial sense in radial grooves in the plate 1, one for each of the three devices which are mounted on the plate 1, and is capable of displacement in a circular, annular slot in a twisting sense, enabling it to be moved between the three devices when the plate 1 is caused to pivot. illustrated in FIG. 4 is a bucking bar device 28, secured to a frame arm 29, which in turn is capable of being caused to rotate about an axis of rotation 30 by means of a connection 31 attached to a second positioning device 32, for which no detailed description is given. FIGS. 3 and 4 are positioned to either side of an imaginary sheet material, i.e. a workpiece 33, in a position for the attachment of a rivet. The bucking bar device is illustrated more clearly in FIGS. 5 and 6 and comprises a stamping body 39 which is guided along a guide 35 of circular cross-section attached to a guide element 36. The guide 35 is provided with a shoulder 37 which limits the forward movement of the stamping body 34 away from the guide element, in which direction the stamping body is acted upon by a force applied by a helical spring 38. The guide element 36 is so arranged as to be capable of displacement in a linear sense in relation to a housing 39 via guides 40, 41. This movement is produced by a linear motor 42, which is attached to a piston 44 in the housing 39 and passes through a bushing in the guide element 36. The housing 39 is executed with a front shoulder surface 45. The stamping body 39 is executed with a rear broader part and a front narrower part, which is executed at its outer end as a contact surface 46. This narrower part projects into a bushing in the housing 39. The stamping body can be adjusted into two positions through the effect of a linear motor 42, on the one hand a rear position in which the contact surface 46 is situated withdrawn from the shoulder surface 45, and on the other hand a front position closer to it.

For the purpose of riveting the bucking bar device 28 is positioned to one side of the workpiece which is to be riveted, as illustrated in FIG. 4, whilst the frame 3 with the three aforementioned devices is positioned on the other side, so that the bracket 24 is applied against one side of the workpiece and the shoulder surface 45 is applied against the other side. The device for drilling 7, the device for positioning the rivets 8 and the device for repetitive striking movements 9 are then caused to move in turn into their operating position, so that a hole is drilled first, a rivet is then placed in the hole, and the rivet is then secured by repetitive striking movements, in conjunction with which the impact force is absorbed by the spring-loaded stamping body 34.

Figure 7:
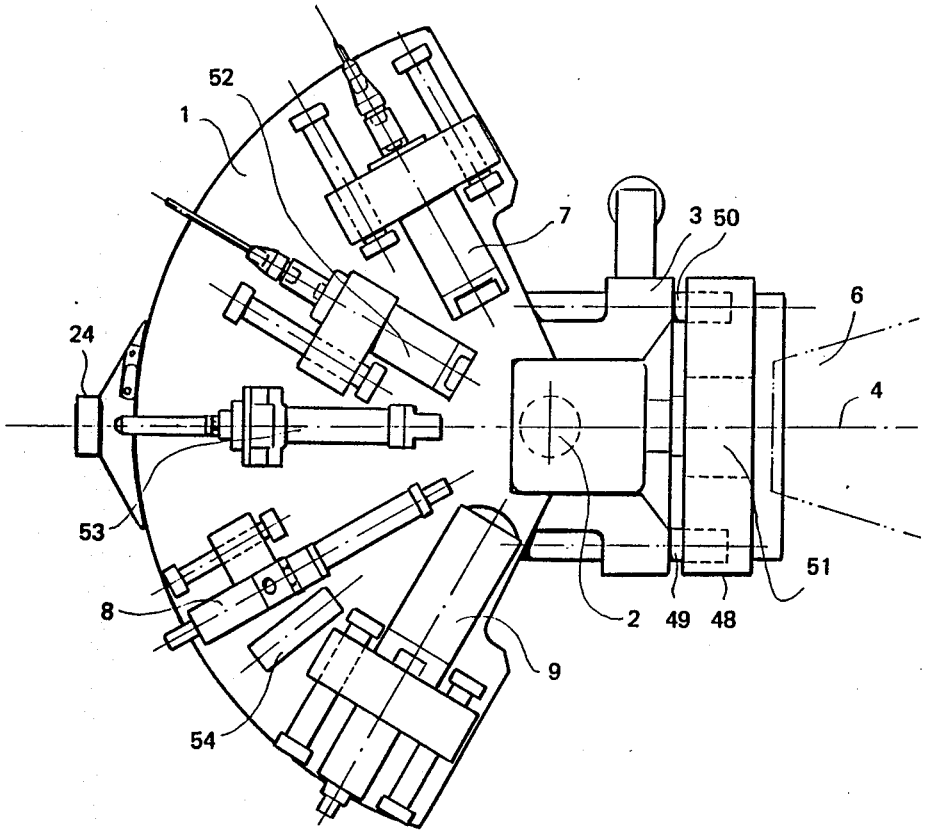
FIG. 7 illustrates an alternative embodiment of the part illustrated in FIG. 1, viewed from above.

Illustrated in FIG. 7 is an alternative embodiment of a part of the arrangement in accordance with the invention, corresponding to the part in FIG. 1, as described above. Those details which have equivalents in FIG. 1 have been given the same reference numbers. As will be appreciated from the Figure, there is present between the first positioning device 6, i.e. the outermost limb of a robot, and the frame 3 a second frame 48 attached to the outermost limb of the robot. The frame 3 is guided in a linear sense on guides 49, 50 in relation to the second frame 48 by means of a linear motor 51, which may be a pneumatic piston/cylinder arrangement. The linear motor 16 (not illustrated in FIG. 7), the purpose of which is to cause the plate 1 to pivot for the purpose of positioning the tools in their operating positions, is in this case a pulse motor, that is to say a stepper motor, which is also true of the linear motor 27 (also not shown in this Figure), for the positioning of the devices for drilling 7, etc., one at a time in a linear sense in their operating position on the plate 1.

In addition to the devices for drilling 7, for positioning the rivets 8 and for repetitive striking movements 9, there are also present in this case a device for reaming 52, a device for the application of a sealing agent 53, and a radar control device 54. Also available, but not illustrated, are a device of a fibre-optic type for checking for the presence of a drill in the device 7, and a device for checking the correct working position of the device 7 for drilling, etc.

This embodiment of the arrangement in accordance with the invention functions as follows:

The bucking bar device 28 is positioned, in the manner previously described, tight up against one side of the workpiece which is to be riveted. By means of the first positioning device 6 the frame 3 is then moved to a fixed position in relation to the second frame 48, so that the bracket 24 adopts a position at a certain distance from the other side of the workpiece, for example 3 mm. The frame is then caused to move by the linear motor 51 until the bracket 24 is in contact with the workpiece at a predetermined contact pressure. Drilling, etc., can then begin. The stepper motors permit the highly accurate adjustment of the tools, etc., so that drilling can be accompanied by countersinking to a precise, predetermined depth. It is appropriate to include fibre-optic cables to sense the presence of a drill in the device 7 for the purpose of checking for broken drills, etc.

The task of the radar control device 54 is to check whether a rivet has been placed in the drilled hole by the device 8 for positioning a rivet. The radar control device 54 interacts with alarm devices and is so arranged as to interrupt the operating process if a rivet has not been placed in the hole drilled for riveting.

We claim:

1. A riveting device for riveting sheet material and especially for riveting of material with a complex shape, comprising drilling means, rivet positioning means, means for repetitive striking movement and bucking bar means, characterized in that said drilling means (7), rivet positioning means (8) and striking movement means (9) are disposed for one at a time movement into the same operating position in relation to frame means (3), said frame means being carried by a first positioning robot means moveable in multiple directions in relation to said sheet material (33), on one side thereof, in conjunction with said bucking bar means (28) wherein said bucking bar means is carried by a second positioning robot means (32) moveable in multiple directions in relation to said sheet material (33), on the other side thereof from said striking means (9) so as to interact with said striking means during the riveting operation.

2. A riveting device according to claim 1 wherein said drilling means (7), rivet positioning means (8) and striking means (9) are arranged for pivotal movement in a plane about a shaft (2) supported by said frame means (3).

3. A riveting device according to claim 2, wherein said drilling, rivet positioning and striking means (7–9) are disposed of plate means (1) pivotally supported for movement in said plane such that the axes of operation of said drilling, rivet positioning and striking means (7–9) converge towards the center of said shaft (2).

4. A riveting device according to claim 3 including motor means (16) coupled to said plate means (1) to cause pivotal movement thereof into its operative positions, and locking means (19) for locking said plate means in said operative positions.

5. A riveting device according to claim 4, wherein said drilling, rivet positioning and striking means (7–9) are so arranged as to be capable of being displaced, one at a time, from rest positions into said operating position by means of a common driving means (27).

6. A riveting device according to claim 1, wherein said bucking bar means (28) comprises a stamping body (34) mounted for linear movement between a front position and a rear position in relation to guide means (26) and biased in the direction of said front position, said guide means (36) being mounted for movement between a front position and a rear position in relation to housing means (39) having a front shoulder surface (45) for contacting said sheet material.

7. A riveting device according to claim 1 wherein said frame means (3) is arranged for movement in relation to said first positioning robot means (6) and carries a bracket means (24) capable of being applied against said sheet material at a predetermined force.

* * * * *